US005231803A

United States Patent [19]

Lanzer

[11] Patent Number: 5,231,803

[45] Date of Patent: Aug. 3, 1993

[54] AUTOMATED RANDOM ORBITAL ABRADING METHOD

[75] Inventor: David J. Lanzer, Hudson, Wis.

[73] Assignee: Minnesota Mining and Manufacturing Company, St. Paul, Minn.

[21] Appl. No.: 867,982

[22] Filed: Apr. 13, 1992

[51] Int. Cl.[5] ..... B24B 1/00; B24B 51/00

[52] U.S. Cl. ..... 51/325; 51/281 R; 51/165.71

[58] Field of Search ..... 51/165.75, 165.71, 328, 51/325, 281 R, 119, 120, 170 T; 901/41, 50

[56] References Cited

U.S. PATENT DOCUMENTS

| | | | |
|---|---|---|---|
| 3,849,949 | 11/1974 | Steinhauser et al. | 51/406 |
| 4,609,581 | 9/1986 | Ott | 428/100 |
| 4,660,329 | 4/1987 | Hutchins | 51/170 |
| 4,702,665 | 10/1987 | Nakashima | 901/50 |
| 4,706,004 | 11/1987 | Komatsu et al. | 318/568 |
| 4,753,044 | 6/1988 | Bula | 51/3 |
| 4,815,780 | 3/1989 | Obrist | 901/41 |
| 4,886,529 | 12/1989 | Hashimoto et al. | 51/165 |
| 4,920,702 | 5/1990 | Kloss et al. | 51/170 |
| 4,926,604 | 5/1990 | Hara | 901/41 |
| 4,967,127 | 10/1990 | Ishiguro et al. | 318/571 |
| 4,996,753 | 3/1991 | Jones | 901/41 |
| 5,067,085 | 11/1991 | Wenzel et al. | 365/474 |

OTHER PUBLICATIONS

Technical Service Bulletin, "Automation and Robotics"; Feb. 1991 of Minnesota Mining and Manufacturing Company.

Leaflet (double-sided) on "8447 Random Orbital Sander with Vacuum Pickup" of the ARO Corporation, No. 8167-T.

Booklet (8 pages) on "New Random Orbital Sanders" of the ARO Corporation, No. 88104-t pp. 30-35 on Dynorbital ® Random Orbital Sanders.

"Random-Orbit Sanders" by Sven Hanson, Jan./Feb. 1992, Fine Woodworking, pp. 46-51.

*Primary Examiner*—Bruce M. Kisliuk
*Assistant Examiner*—Bo Bounkong
*Attorney, Agent, or Firm*—Gary L. Griswold; Walter N. Kirn; Peter L. Olson

[57] ABSTRACT

The present invention relates to an automated random, orbital abrading apparatus and a method for positioning the back-up pad of the apparatus at a known location within its range of motion at the end of an abrading cycle.

6 Claims, 5 Drawing Sheets

AUTOMATED RANDOM ORBITAL ABRADING METHOD

TECHNICAL FIELD

This invention relates to a method of positioning the back-up pad of a random orbital abrading apparatus at a known location within its range of motion.

BACKGROUND OF THE INVENTION

Abrasives are commonly used to grind, sand, and polish materials such as wood, metal, and plastic. Grinding, sanding, and polishing may be generically be referred to as abrading, because each process involves the removal of material, either on a macroscopic or a microscopic scale, due to abrasion between contacting surfaces in relative motion. One method of abrading a workpiece is to affix an abrasive sheet member to a back-up pad, and to rotate the back-up pad while urging the abrasive against a workpiece. In many applications, the abrasive member and the back-up pad are circular, and although the abrasive member will be referred to as an abrasive disc hereinafter, other configurations are also known. For example, U.S. Pat. No. 4,920,702 (Kloss et al.) discloses a portable grinder having, in one embodiment, a generally triangular back-up pad and abrasive disc that are vibrated rather than rotated.

The abrasive disc may be affixed to the back-up pad in a number of different ways. For example, the use of a pressure sensitive adhesive (see U.S. Pat. No. 3,849,949 (Steinhauser et al.)), interengaging fastener members, such as a multiplicity of hook portions on the back-up pad and a multiplicity of loop portions on the abrasive disc (see U.S. Pat. No. 4,609,581 (Ott)), and cooperating male and female fastener members, are known in the art. The back-up pad may be constructed of various materials (e.g. rubber) depending on the desired stiffness of the back-up pad. The diameter of the abrasive disc is typically larger than the diameter of the back-up pad (for example, a 127 mm disc and a 124 mm pad), in order to permit abrading near the periphery of the abrasive disc without damage to the back-up pad. Because an even finish may be important, it is also desirable to center the abrasive disc on the back-up pad so that the amount by which the disc overlaps the back-up pad is relatively constant along the periphery of the disc.

The back-up pad is attached to an abrading apparatus, which includes a rotating output shaft that is powered by an abrading head. These abrading apparatuses, alternatively referred to as grinders herein, may be either electrically or pneumatically powered, and typically rotate the back-up pad at speeds between 3,000 and 20,000 revolutions per minute. The abrading apparatus may be one of several types. For example, a rotary grinder simply rotates the back-up pad and attached abrasive disc about a fixed axis. This may cause the abrasive face of the disc to abrade deeper scratches into the surface of the workpiece, because the abrasive face follows the same path during each rotation of the disc. This regular rotary motion can result in deeper, coarser cutting, which may be desirable for some applications, but not for others.

The particular type of grinder with which the present invention is concerned is the random orbital grinder. This type of grinder combines a rotary and orbital motion which results in a random motion of the back-up pad with respect to the abrading head. Such a motion is desirable because a random motion of the abrasive decreases the likelihood that a regular pattern of deeper scratches will be cut into the surface of the workpiece. As a result, a finer finish may be obtained on the surface of the workpiece. The random motion may be generated by a structure akin to that shown in FIG. 1. Abrading apparatus 10 includes abrading head 11, which carries drive shaft 12, which is rotated on journal bearing 16 about axis A—A by power source 18, which may be, for example, electric or pneumatic. It should be understood that the terms "rotate" and "revolve" are not intended to be synonymous for purposes of the present invention. Rotation herein refers to the angular movement of a body about the central axis of the object. Revolution herein refers to the angular movement of a body about an axis spaced from the central axis of the object. In the context of the illustrated abrading apparatus 10, housing 20 rotates with drive shaft 12 about axis A—A, and houses second shaft 22, which rotates with journal bearings 24 and 26 about axis B—B. Axis B—B is parallel to but spaced from axis A—A, and therefore second shaft 22 tends to revolve around axis A—A, while rotating about axis B—B.

Second shaft 22 carries part 30, including counterweight 32, which counterweight assists in effecting revolution of part 30 about axis A—A. It should be noted that the speed of rotation of part 30 about axis B—B may depend on parameters such as the amount of force applied to the grinder, the material composition and topography of the workpiece, and the abrasive that is used. For example, under very light pressure, part 30 may rotate relatively quickly whereas under a very high load, part 30 may rotate relatively slowly, or not at all, although it would probably continue to revolve about axis A—A. Back-up pad 34 is connected to part 30, and has abrasive disc 36 releasably mounted thereon. The general operating principles of a random, orbital grinder are further described in a variety of sources known in the art, including U.S. Pat. No. 4,660,329 (Hutchins), the contents of which are hereby incorporated by reference.

The combined effect of the revolution and rotation of part 30, and therefore of back-up pad 34 and abrasive disc 36, produces a random, orbital sanding motion. The random action of the abrasive results in a finish that is finer than would result from a rotary grinder, because the path of the abrasive disc is random with respect to the workpiece, which helps to prevent the abrasive disc from abrading deeper scratches during each rotation.

Although manually abrading a workpiece is advantageous under certain circumstances, the cost of manual abrading may be excessive for large-scale manufacturing operations. When a continuous series of identical workpieces are to be abraded in an identical manner, manufacturers have found it useful to implement robots to abrade each successive workpiece identically. Robotic apparatuses can be programmed to follow a predetermined sequence of commands that position an attached grinder at a specific location to abrade the workpiece, and therefore to complete the abrading process with a minimum of human intervention.

In order to abrade each workpiece effectively, a worn abrasive disc must be replaced periodically with a new abrasive disc at the end of an abrading cycle. As used herein, an abrading cycle begins when the disc is applied to the back-up pad and ends when the disc is to be removed. In most cases, the abrading cycle corresponds to the useful life of the disk, but the abrading cycle may be shorter if, for example, a finer or coarser abrasive disc is desired. For simplicity, the abrasive disk that is to be removed at the end of the abrading cycle will be referred to as the worn abrasive disc. If a human operator must replace the worn abrasive discs at regular intervals, which may be relatively often depending on the abrasive and the material from which the workpiece is constructed, the benefit of having a robotic apparatus replace a human operator is diminished. Thus it is desirable to provide an integrated, automated system for removing and replacing a worn abrasive disc.

To program an automated apparatus to remove a worn abrasive disc, the position of the disc at the completion of the abrading cycle must first be ascertained. In the case of a rotary grinder, determining the location of the disc is relatively simple, because the position of the back-up pad and disc does not change with respect to the position of the abrading head. However, in the case of a random, orbital grinder, the back-up pad and attached abrasive disc will likely be at a different location at the end of each cycle, because the back-up pad does not follow a designated path—its action is random within a measurable range of motion. For example, a possible range of motion of a back-up pad with respect to the abrading head is shown in FIG. 3 by distance "d". It is therefore more difficult to consistently locate the back-up pad and disc with respect to the abrading head of a random, orbital grinder than of a rotary grinder.

In order to grasp the worn disc that is attached to the back-up pad, the robotic apparatus must be programmed to present the disc at a constant, specified location at the end of each abrading cycle for convenient engagement and removal by a grasping device. However, the device typically grasps only the outermost edge of the disc, and thus even minor variations in the location of the disc may prevent an automated grasping device from grasping the disc. As shown in FIG. 3, the position of the back-up pad (34 and 34') at the end of an abrading cycle may vary by a distance "d" due to the cooperative movement of the illustrated components. Because the abrasive disc overlaps the back-up pad by only a small amount, an automated grasping device that is programmed to grasp an edge of an abrasive disc at a certain location may, depending on the point at which the back-up pad stops, be unable to grasp the abrasive disc. Thus the automated grasping means may be unable to locate the disc for removal unless the back-up pad is uniformly positioned at a specific point in its range of motion. It is the necessity for precisely locating the back-up pad within its range of motion with which the present invention is particularly concerned.

Even if the worn abrasive disc is somehow removed from the back-up pad at the end of the abrading cycle, other problems may result from the inability to precisely locate the back-up pad and abrasive disc at the end of each abrading cycle. If the location of the back-up pad is not precisely determined at the end of the abrading cycle, the new abrasive disc may not be centered on the back-up pad. The improper alignment of the disc with respect to the pad could cause the edges of the abrasive disc to tear, to abrade unevenly, or even to detrimentally affect the grinder bearings due to the imbalance. Furthermore, an incorrectly positioned disc could fly off during grinding, which could potentially injure a person or property. An abrasive disc that is not centered on the back-up pad could expose a portion of the edge of the pad, which can damage both the back-up pad and the workpiece. Finally, it may be difficult to abrade edges or contoured surfaces with an abrasive disc that is not centered, because the some portions of the periphery of the abrasive disc may abrade more material from the workpiece than other portions that may not overlap the back-up pad by as great an amount.

It is therefore desirable to provide an automated random, orbital grinding system including means for locating and removing an abrasive disc from the back-up pad thereof, as well as a method for positioning the back-up pad of a random, orbital grinder at a known location within its range of motion at the end of an abrading cycle.

SUMMARY OF THE INVENTION

According to the present invention there is provided a method for use with an automated random orbital sanding apparatus having an abrading head and a back-up pad attached thereto and adapted for random orbital movement through a range of motion with respect to the abrading head. The back-up pad releasably carries an abrasive disc on a major surface thereof, and the abrasive disc has an abrasive face and a back face. The method for positioning the back-up pad at a known location within its range of motion comprises (a) contacting a positioning member with at least one of the abrasive disc and the back-up pad, and (b) inducing relative motion between the abrading head and the positioning member while maintaining contact between the positioning member and at least one of the abrasive disc and the back-up pad to urge the back-up pad to a known location within the range of motion. In one embodiment, the invention provides for moving the abrading head with respect to a stationary positioning member.

The described method may also include the steps of (c) grasping the abrasive disc with a grasping device, and (d) inducing relative motion between the grasping device and the back-up pad to remove the abrasive disc from the back-up pad. The method may also further include the steps of (e) providing a supply of abrasive discs, with each disc substantially in register and with a back face presented for engagement with the major surface of the back-up pad, (f) moving the back-up pad to a position aligned with and spaced from the supply after removal of an abrasive disc from the back-up pad, and (g) contacting the top abrasive disc of the supply with the back-up pad to engage the top abrasive disc of the supply. In another embodiment, more than one supply of abrasive discs may also be provided.

Also provided is an automated random orbital abrading system. The system includes (a) an automated robotic apparatus including an arm component and a control system for directing the movement of the arm component in response to a sequence of commands, the robotic apparatus further including a source of rotary power, (b) an abrading head attached to the arm component, the abrading head comprising a back-up pad rotatively attached to the abrading head and operatively connected to the rotary power source, the back-up pad and the abrading head cooperatively adapted for random movement of the back-up pad through a range of motion with respect to the abrading head, the back-up pad having a major surface adapted to carry an abrasive disc thereon, (c) an abrasive disc having a back face releasably attached to the major surface and having an abrasive face adapted to abrade a workpiece; and (d)

means for positioning the back-up pad at a known location within said range of motion. The robotic apparatus is adapted to contact at least one of said abrasive disc and said back-up pad with said positioning means and to induce relative movement therebetween responsive to said sequence of commands while maintaining contact between said positioning means and at least one of said abrasive disc and said back-up pad to urge the back-up pad to a known position within said range of motion.

BRIEF DESCRIPTION OF THE DRAWINGS

The invention will be more readily understood with reference to the accompanying drawings, wherein like reference numerals refer to like components throughout the several views, and wherein.

DETAILED DESCRIPTION

Figure 2:
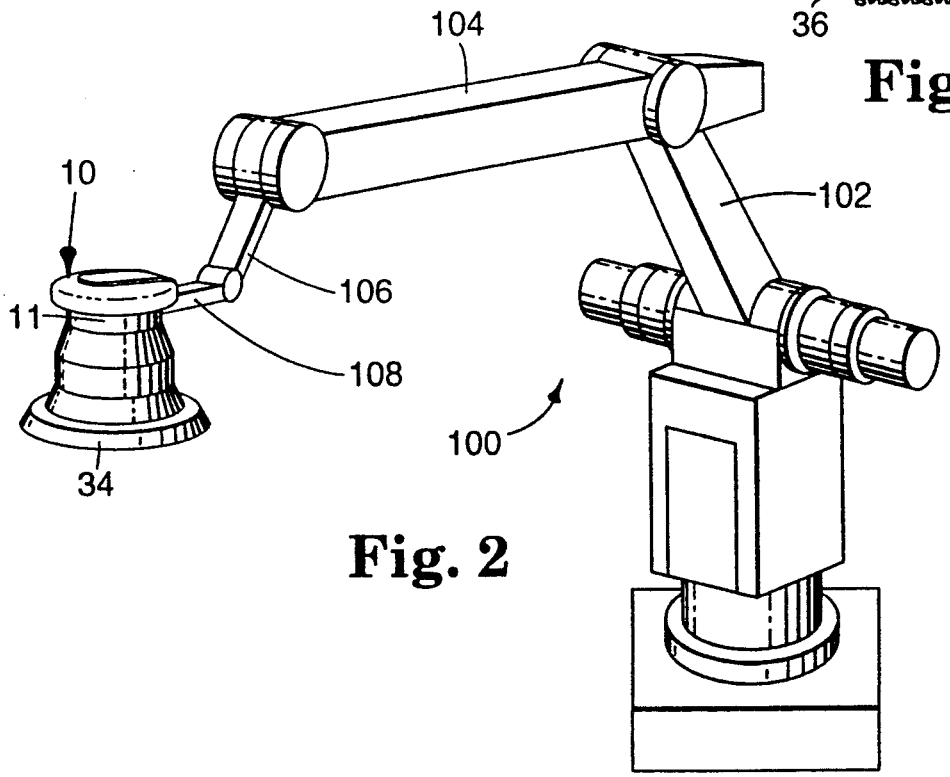
FIG. 2 is a perspective view of a conventional robotic apparatus having a random orbital grinder attached thereto.
Figure 3:
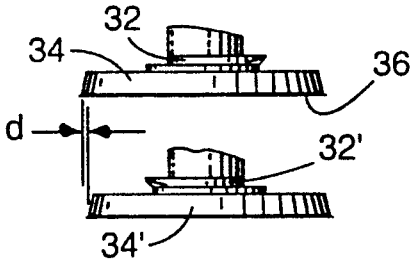
FIG. 3 is a side view of two possible positions of the back-up pad of a random, orbital grinder at the end of an abrading cycle.

The present invention relates in general to an automated, random orbital abrading system for removing material from a workpiece, and for positioning a back-up pad and attached abrasive disc at a known location at the completion of an abrading cycle. After the back-up pad has been positioned, other operations may be performed with respect to the abrading head and back-up pad, such as removing and replacing a worn abrasive disc. As shown particularly in FIG. 2, automated robotic apparatus 100 includes arm components 102, 104, 106, and 108, and further includes a control system for directing the movement of the arm component in response to a sequence of commands. A wide variety of robotic apparatuses may have utility in the context of the present invention, including Model No. $T^3786$, available from the Cincinnati Milacron Corp. of Lebanon, Ohio, and the present invention should be understood to have utility robots of varying sizes, work capacities, and levels of sophistication. Furthermore, other fixed automation systems, or task specific robotic apparatuses may have utility in the context of the present invention.

Figure 1:
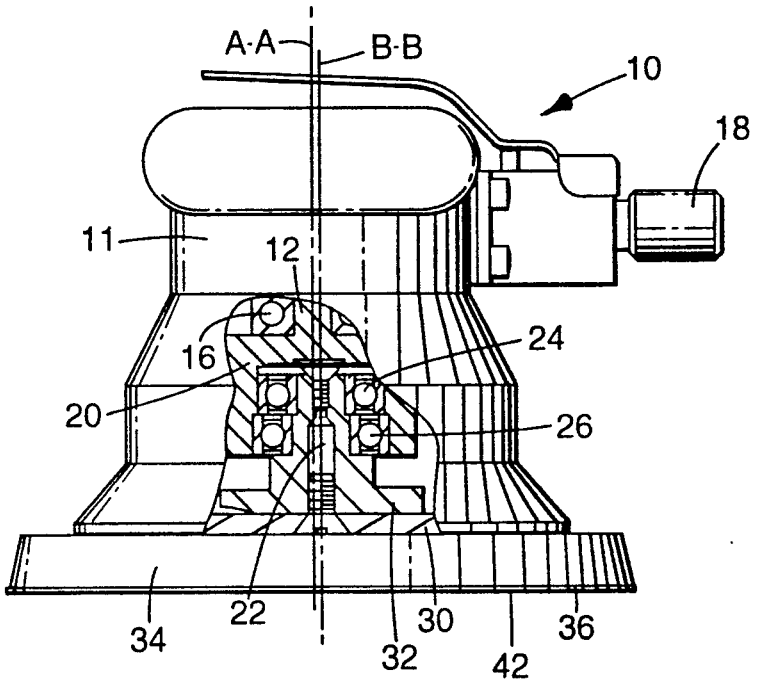
FIG. 1 is a partial cut-away view of a conventional random orbital grinder.

Robotic apparatus 100 carries abrading apparatus 10 at the distal end of arm component 108, and supplies rotary power (e.g. electrically or pneumatically) to abrading apparatus 10 by means known in the art, and therefore not shown. Abrading apparatus 10 is of the type generally depicted in FIG. 1, and includes abrading head 11, drive shaft 12, counterweight 32, housing 20, second shaft 22 and back-up pad 34. An exemplary abrading apparatus is available from the Hutchins Manufacturing Co. of Pasadena, Calif. under Part No. 4500. As described previously, drive shaft 12 and housing 20 are rotated about axis A—A by drive means. Due to the angular movement of housing 20 about axis A—A, second shaft 22 and back-up pad 34 tend to rotate about axis B—B. Because axis B—B is spaced from axis A—A, the rotation of back-up pad 34 about axis B—B, when combined with the revolution of second shaft 22 around axis A—A, results in a random, orbital abrading motion of back-up pad 34 with respect to axis A—A. The random, orbital motion of the back-up pad is limited to a specified range of motion, which may vary depending upon the size and placement of the component parts of abrading head 11.

Figure 1A:
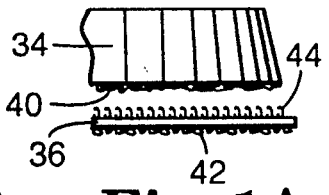
FIG. 1A is an exploded view of the interface between an abrasive disc and the back-up pad to which it is attached.

As illustrated in FIG. 1A, back-up pad 34 is adapted to carry an abrasive disc thereon, and includes major surface 40 that is adapted to cooperatively engage a first surface of the abrasive disc. Abrasive disc 36 includes an abrasive face 42 and a back face 44, and back face 44 includes means for cooperatively engaging back-up pad 34. An example of such engaging means is shown in U.S. Pat. No. 4,609,581 (Ott), which generally includes a multiplicity of hook portions projecting from the major surface of back-up pad and a multiplicity of loop portions projecting from the back face of the abrasive disc. Engaging means could also comprise other means known in the art, including a female fastening portion formed in the back-up pad and a male fastening portion formed on the abrasive disc, a pressure sensitive adhesive backing on at least one of the abrasive disc and the back-up pad, and the like.

The present invention generally provides for positioning back-up pad 34 and disc 36 at a known location within its range of motion after each abrading cycle. From that known location, robotic apparatus 100 may be programmed to move abrading apparatus 10 to specific positions to complete subsequent operations. A particularly advantageous feature of the invention is the simplicity of operation, which is illustrated generally at FIGS. 4 through 7.

Means for positioning the back-up pad at a known location within its range of motion are provided, and an exemplary positioning means is illustrated in FIGS. 4 through 7 as projecting positioning member 50. Other such positioning means will be described further hereinafter, and may include a generally planar surface, adjacent projecting members, and the like. Positioning member 50 is adapted for contact with abrasive face 42 of abrasive disc 36, and is located within the range of arm component 108 of robotic apparatus 100. This contact enables the apparatus to move abrading head 11 through a sequence of movements with respect to positioning member 50. Robotic apparatus 100 is adapted to follow a programmed sequence of commands that direct the movements of the arm component, as is well known in the art, and thus only the sequential movements of abrading head 11 will be discussed, rather than the steps necessary to program the apparatus to perform such movements.

Figure 4:
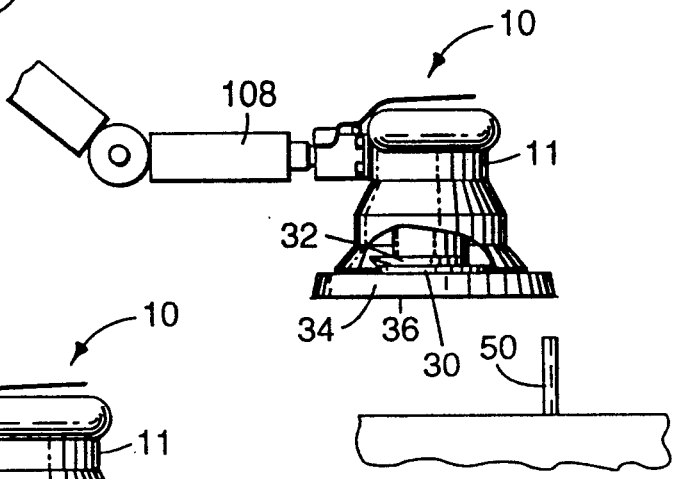
FIGS. 4 through 7 are successive views of the motion of a random orbital grinder and a positioning member in accordance with the present invention.
Figure 5:
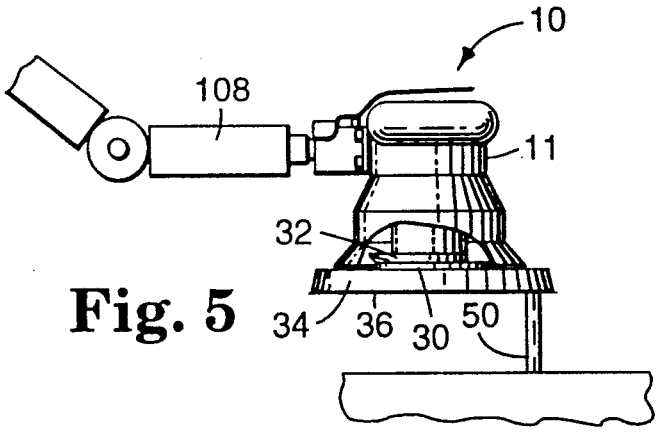

The first step in the method of the present invention is to contact positioning member 50 with abrasive face of disc 36, as shown in FIGS. 4 and 5. A force sufficient to maintain contact between positioning member 50 and disc 36 (for example, 2.3 kg (5 lbs.)) during the movements described hereinbelow is applied by robotic apparatus 100. The abrasive face of disc 36 preferably contacts positioning member 50 at a point near the periphery of disc 36 opposite arm component 108, as shown at 60 in FIG. 10.

After the robotic apparatus has contacted abrasive disc 36 and positioning member 50, abrading head 11 is moved along a predetermined path by the robotic apparatus with respect to positioning member 50. The movement of abrading head 11 with respect to positioning member 50 causes back-up pad 34 both to rotate (about axis B—B) and to revolve (around axis A—A). The revolution of the back-up pad as the abrading head travels along the predetermined path positions the back-up pad at one extreme of its range of motion. In the illustrated embodiment, the back-up pad revolves until it is nearest the arm component, which constitutes a known location of the back-up pad with respect to the abrading head. This known location allows other operations to be performed with respect to the back-up pad, such as removing a worn abrasive disc and applying a new disc. It should be noted that the back-up pad may be moved to any known location within its range of motion at the end of each abrading cycle. For example, the path of the abrading head with respect to the positioning member may cause the back-up pad to revolve toward one side of the abrading head. This may be an acceptable known location, because the subsequent movements of the abrading apparatus can be programmed with respect to that location.

Figure 10:
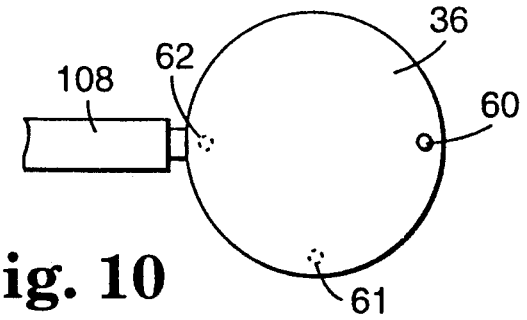
FIGS. 10 and 11 illustrate successive positions of the positioning member of the present invention with respect to the back-up pad.
Figure 11:
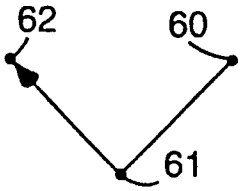

The predetermined path selected for the travel of abrading head 11 with respect to projecting positioning member 50 preferably includes an intermediate point 61 that is spaced from a line connecting beginning point 60 and end point 62, as shown in FIGS. 10 and 11. This preferred path is used because the center of mass of the counterweight structure may line directly along the line connecting the beginning and ending points. Such a position of the counterweight could make it difficult to force the back-up pad to revolve in either revolutional direction if a straight-line path is used. However, if a path having an intermediate point spaced from a line connecting the beginning and ending points is used, the counterweight structure will tend to revolve in the desired manner. Although shown in FIG. 11 as two straight lines intersecting at approximately a right angle, the path may be a curve or any other combination of lines connecting the beginning point and the end point.

Figure 6:
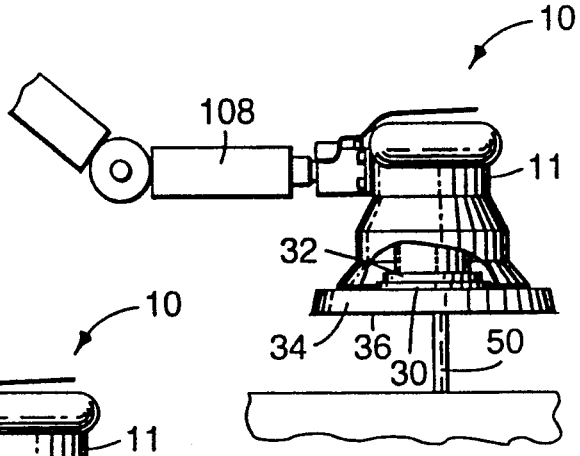
Figure 7:
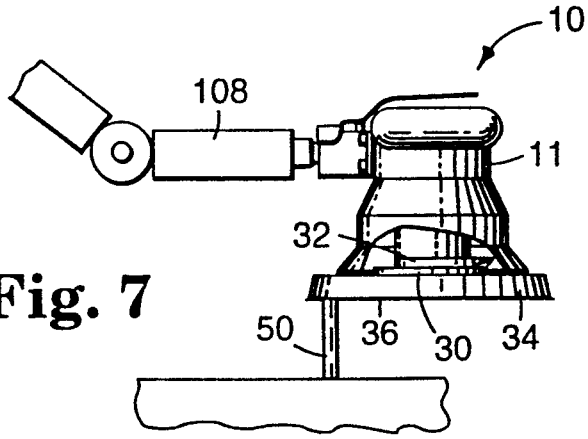

FIG. 4 illustrates one possible location of the back-up pad at the end of an abrading cycle. In this location, counterweight 32 is generally opposite the side of the disc where projecting positioning member 50 initially contacts the abrasive face of the disc. As abrading head 11 travels along its path, as shown in FIG. 6, back-up pad 34 begins to revolve away from its initial location until, as abrading head reaches the end point of its path, back-up pad 34 is located at the edge of its range of motion closest to arm component 108, as shown in FIG. 7. In essence, positioning member 50 has "dragged" back-up pad 34 toward one extreme in its range of motion as abrading head travels along the predetermined path. It should be reemphasized that the coordinates of the path, including the location of the beginning and ending points, may be adjusted to suit the particular application and the geometry of the abrading apparatus, and should not be limited to the simplified path described herein and shown in the accompanying drawings.

Figure 8:
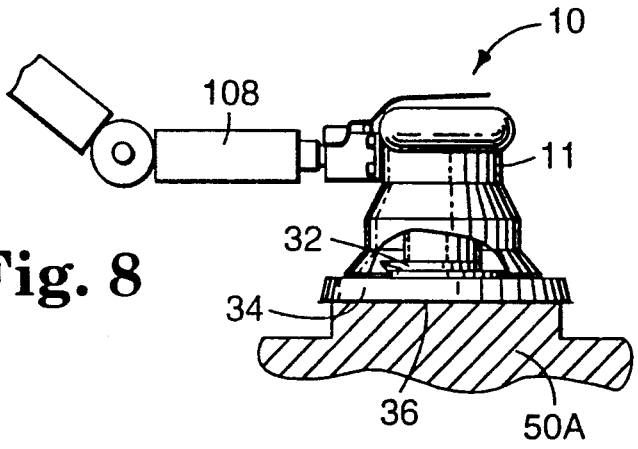
FIGS. 8 and 9 illustrate alternate embodiments of the positioning member of the present invention.
Figure 9:
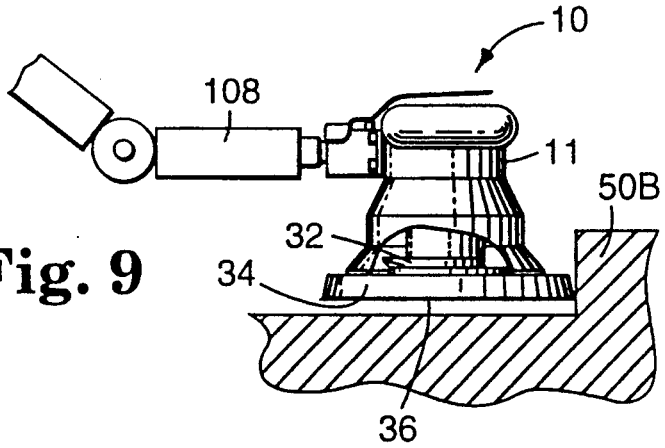

In the preferred embodiment, positioning means comprises a single projecting positioning member 50, as shown in FIGS. 4 through 7 and as discussed above. However, it is also within the scope of the present invention to provide positioning means that are, for example, planar or curvilinear surfaces, or two or more projecting positioning members. As illustrated in FIG. 8, a surface 50A could be generally parallel to the major surface of back-up pad 34 and adapted for contact with the abrasive face in much the same manner as the projecting positioning member discussed above. Alternatively, a surface 50B could be generally perpendicular to the major surface of back-up pad 34, as shown in FIG. 9. Surface 50B would enable at least one of the back-up pad and the attached abrasive disc to contact the surface in order to position the back-up pad at the aforementioned known location. In yet another embodiment, two or more spaced projecting positioning members may be provided, against which the periphery of at least one of the back-up pad and the attached abrasive disc may be contacted to position the back-up pad. The referenced embodiments that include one or more members or surfaces extending perpendicular to the major surface of the back-up pad may contact either the back-up pad alone, the disc alone, or the back-up pad and the disc together. Thus these embodiments refer to contact with at least one of the back-up pad and the abrasive disc.

It is important to note that the illustrated embodiment shows a stationary positioning member and a moving abrading head. It is also within the scope of the present invention to provide a positioning member that moves with respect to an abrading head that is held stationary, or to provide a positioning member and abrading head that each move relative to the other, in order to bring about the described result. Thus the method of the present invention includes the step of inducing relative motion between the abrading head and the stationary member while maintaining contact between the stationary member and the abrasive surface to position the back-up pad at a known location within the range of motion, which is expressly intended to encompass the possibilities just described.

Figure 12:
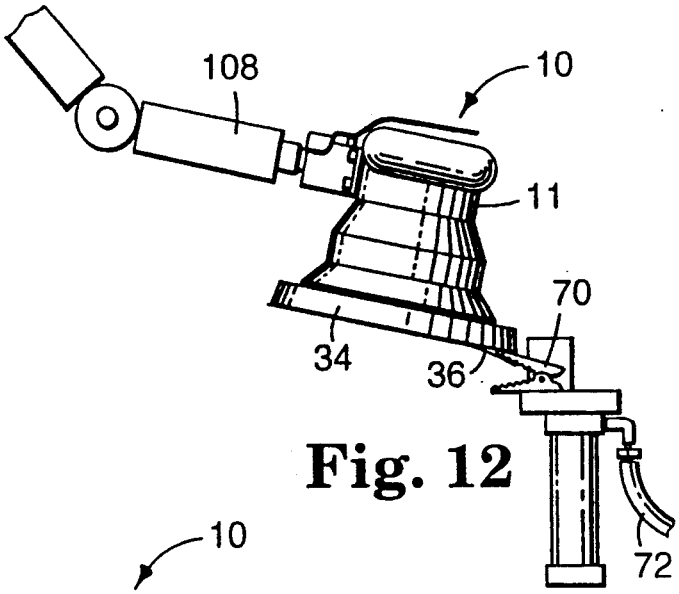
FIGS. 12 through 14 are schematic representations of successive steps in the automated removal of an abrasive disc from the back-up pad according to the present invention.
Figure 13:
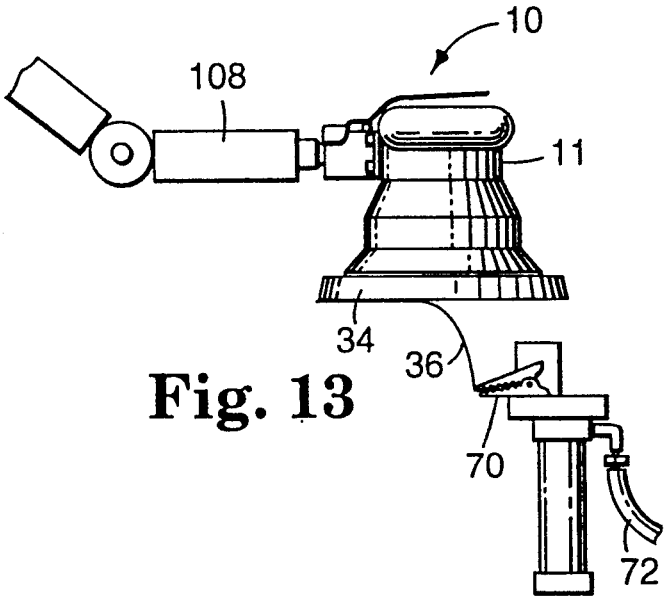
Figure 14:
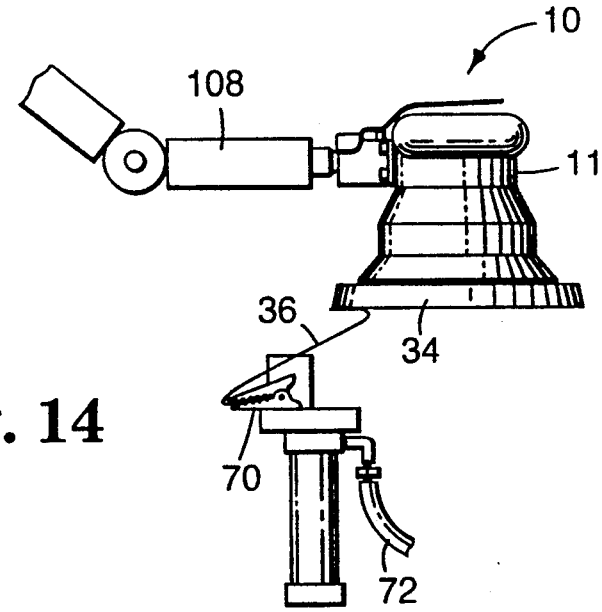

By positioning back-up pad 34 at a known location (i.e. one extreme of its range of motion) at the completion of an abrading cycle, the robotic apparatus that carries the abrading head may be programmed to perform other subsequent operations. One such operation is that of removing a worn abrasive disc and replacing it with a new abrasive disc, although other operations are also possible. In order to remove the worn abrasive disc, means for grasping the abrasive disc are provided, and in the illustrated embodiment at FIGS. 12 through 14 are shown as grasping device 70. Grasping device 70 is located within the reach of robotic apparatus 100, and is adapted to grasp a disc at a point on the periphery of the disc. Grasping device 70 is responsive to a command or sequence of commands from robotic apparatus 100, which commands are transmitted in the illustrated embodiment through pneumatic input 72. Thus grasping device 70 may be programmed to grasp and to release disc 36.

In the illustrated embodiment, abrading head 11 is moved with respect to grasping device so as to enable the device the grasp an edge of the subject abrasive disc, as shown in FIG. 12. Grasping device 70 is shown as what is commonly known as an "alligator clip," but could also comprise any other known grasping device or devices. For example, one or more projecting members (e.g. fingers or rods) that are interposed between disc 36 and back-up pad 34 to separate them may be used as a grasping device, as well as an adhesive or vacuum source that contacts the abrasive face of the disc to hold it for removal, and the like. When the grasping device is positioned to grasp the abrasive disc, a command from the robotic apparatus to the grasping device enables it to grasp at least an edge of the disc. In the illustrated embodiment, the command is in the form of a pneumatic signal through pneumatic input 72, which closes the grasping device.

In the preferred embodiment, the grasping device is held stationary while the abrading head is moved, in order to separate the abrasive disc from the back-up pad as shown in FIG. 13. However, it is within the scope of the present invention to provide instead a grasping device that is adapted to move with respect to the abrading head, or to move the abrading head and the grasping device relative to each other to separate the abrasive disc from the back-up pad. Thus the method of the present invention includes the step of inducing relative motion between the grasping device and the back-up pad to remove the abrasive disc from the back-up pad, which is expressly intended to encompass the possibilities just described.

It is preferred that the abrading head be moved relative to the grasping device in a path similar to that shown in FIGS. 13 and 14. That is, the initial motion of the abrading head is upward with respect to the grasping device, followed by a translational motion toward and past the grasping device until the abrasive disc has been peeled from the back-up pad. This motion is preferred in part because it does not disturb the location of the back-up pad relative to the abrading head. The peeling force applied by the grasping device urges the back-up pad toward an extreme in its range of motion, just as the force of the positioning member did in the steps earlier recounted. Thus the path followed by the abrading head with respect to the grasping device should, at a minimum, conclude with a movement that will urge the back-up pad toward the same location within its range of motion as the positioning member urged it previously. This will tend to maintain the back-up pad in the desired, and known location, to enable further operations to be programmed with respect to that known location. Alternately, a procedure similar to that performed to position the back-up pad at a known location within its range of motion originally, could again be performed to position the back-up pad in the desired and known location, but such a practice is time consuming and therefore should be avoided if possible. Finally, a second command is transmitted from the robotic apparatus to the grasping device to release the worn abrasive disc, in order to prepare for succeeding operations.

Figure 15:
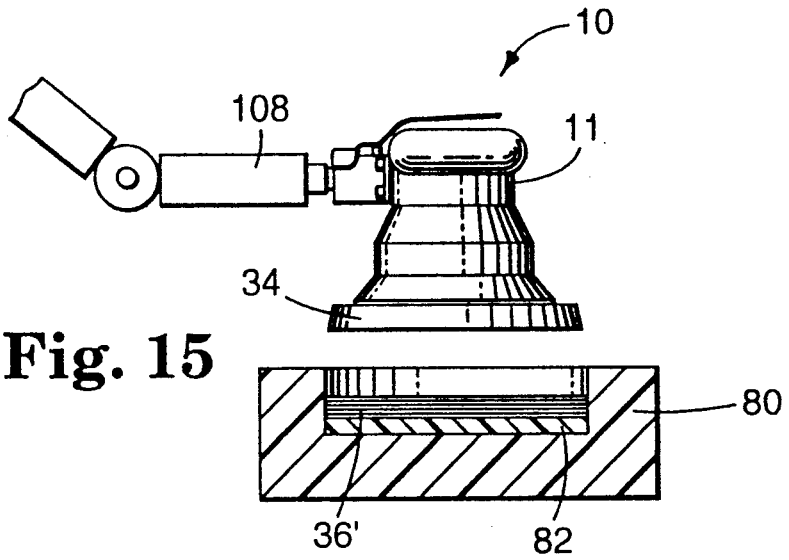
FIGS. 15 through 17 are schematic representations of successive steps in the automated application of an abrasive disc to the back-up pad according to the present invention.
Figure 16:
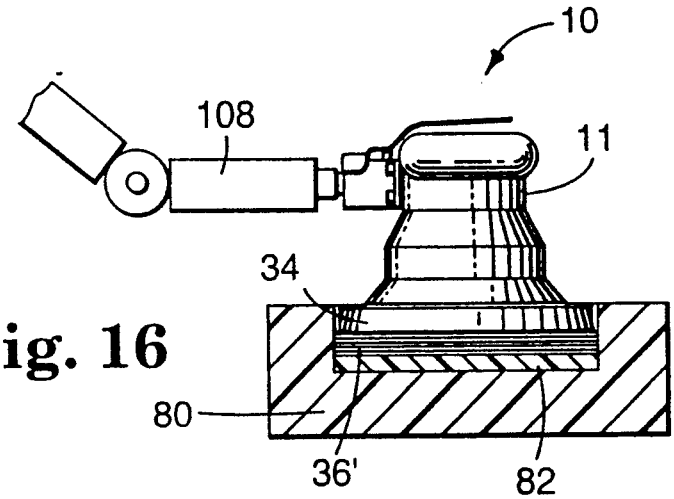
Figure 17:
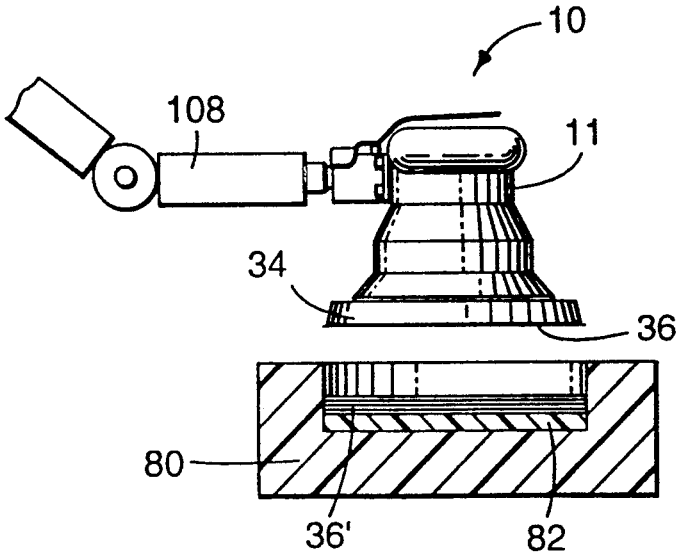

Once the worn abrasive member has been removed, the abrading head may be positioned to contact a new abrasive disc, as shown in FIGS. 15 through 17. Abrading head 11 is initially positioned such that back-up pad 34 is aligned with and spaced from a supply 80 of abrasive discs 36, each of which includes a back face that is presented and adapted for cooperative engagement with the back-up pad. A supply having only one disc is possible, but the preferred mode is to provide a plurality of stacked abrasive discs in each supply. The discs 36 should be substantially in register, because the abrading head will follow an identical path during each cycle, and therefore each successive disc should be in the same location as the previous disc. Such an arrangement should help to prevent the problems that may be encountered when a disc is not properly aligned on the back-up pad. A resilient cushioning member 82 (e.g. foam) is preferably located beneath supply 80 to allow the abrading head to press against the top disc of supply 80 to ensure contact between the back-up pad and that disc.

For some applications, it may be beneficial to provide more than one supply of abrasive discs. For example, a robotic apparatus may be programmed to engage a first disc that includes a coarse abrasive, abrade a workpiece, remove the disc and replace it with a disc from a second supply having a finer abrasive, and so on. By providing such an array of discs, a workpiece may be abraded to remove large quantities of material (perhaps when the workpiece is first removed from a mold), and to be abraded during successive steps to remove decreasing amounts of material until an acceptable finish is presented.

The present invention has now been described with reference to several embodiments thereof. It will be apparent to those skilled in the art that many changes can be made in the embodiments described without departing from the scope of the invention. For example, the method and apparatus of the present invention could be appropriately modified to incorporate non-circular abrasive sheet members, different types of devices that replace the grasping device, positioning means or grasping devices that move with respect to the abrading head, or other positioning means as described above. Alternately, the present invention could be modified to position the back-up pad at a known position in the range of motion that is not at an extreme of that range of motion. Thus, the scope of the present invention should not be limited to the structures described herein, but only by structures described by the language of the claims and the equivalents of those structures.

I claim:

1. A method for positioning the back-up pad at a known location within its range of motion, the method for use with an automated random orbital sanding apparatus having an abrading head and a back-up pad attached to the abrading head and adapted for random orbital movement through a range of motion with respect to the abrading head, the back-up pad releasably carrying an abrasive disc on a major surface thereof, the abrasive disc having an abrasive face and a back face, the method comprising:

(a) contacting a positioning member with at least one of the abrasive disc and the back-up pad; and (b) inducing relative motion between the abrading head and the positioning member while maintaining contact between the positioning member and the at least one of the abrasive disc and the back-up pad to urge the back-up pad to a known location within its range of motion.

2. The method of claim 1, wherein step (b) includes moving the abrading head with respect to a stationary positioning member.

3. The method of claim 1, further including the steps of:

(c) grasping the abrasive disc with a grasping device; and (d) inducing relative motion between the grasping device and the back-up pad to remove the abrasive disc from the back-up pad.

4. The method of claim 3, wherein step (d) includes moving the abrading head with respect to a stationary grasping device.

5. The method of claim 3, further including the steps of:

(e) providing a supply of abrasive discs, each disc substantially in register and with a back face presented for engagement with the major surface of the back-up pad;

(f) moving the back-up pad to a location aligned with and spaced from the supply after removal of an abrasive disc from the back-up pad; and (g) contacting a top abrasive disc of the supply with the back-up pad to engage the top abrasive disc of the supply.

6. The method of claim 3, further including the steps of:

(e) providing a plurality of supplies of abrasive discs, each supply comprising a plurality of discs substantially in register and including a back face presented for engagement with the major surface of the back-up pad;

(f) moving the back-up pad to a location aligned with and spaced from one of the supplies after removal of an abrasive disk from the back-up pad; and (g) contacting a top abrasive disc of the supply of step (f) with the back-up pad to engage the top abrasive disc of the supply.

* * * * *